US007881654B2

(12) United States Patent
Ueda et al.

(10) Patent No.: US 7,881,654 B2
(45) Date of Patent: Feb. 1, 2011

(54) IMAGE PROCESSING APPARATUS

(75) Inventors: Naofumi Ueda, Kyoto (JP); Yusuke Nagai, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 851 days.

(21) Appl. No.: 11/827,806

(22) Filed: Jul. 13, 2007

(65) Prior Publication Data

US 2008/0019752 A1 Jan. 24, 2008

(30) Foreign Application Priority Data

Jul. 21, 2006 (JP) ..... 2006-199182

(51) Int. Cl.
*G03G 15/00* (2006.01)

(52) U.S. Cl. ..... 399/407; 399/366

(58) Field of Classification Search ..... 399/407, 399/366; 400/621

See application file for complete search history.

(56) References Cited

U.S. PATENT DOCUMENTS 2,951,712 A * 9/1960 De Dube ..... 283/42
4,863,194 A * 9/1989 Friedman ..... 283/38
2005/0127596 A9* 6/2005 Trovinger et al. ..... 271/207
2006/0050926 A1* 3/2006 Iwamura ..... 382/100

FOREIGN PATENT DOCUMENTS

JP 07-101105 4/1995
JP 2003-001905 1/2003

* cited by examiner

*Primary Examiner*—Daniel J Colilla
*Assistant Examiner*—Allister Primo
(74) *Attorney, Agent, or Firm*—Edwards Angell Palmer & Dodge LLP; David G. Conlin; David A. Tucker

(57) ABSTRACT

A document is made which consists of a large number of recording sheets whose originality can be certified with reliability. Different specific images are respectively formed on a plurality of recording sheets of recording sheets outputted in constant order. Confirmation holes are formed on recording sheets at higher levels than the recording sheets with the specific images formed thereon, in positions in conformity with the positions of the specific images. When a document made by stacking those recording sheets is seen from the top, and the specific images are visible through the confirmation holes, the originality of the document can be certified. When the specific image is invisible through the confirmation hole, it is found that the document has been changed due to missing of part of the recording sheets, a change in order of the recording sheets, or the like, and hence the originality of the document cannot be certified.

11 Claims, 14 Drawing Sheets

IMAGE PROCESSING APPARATUS

BACKGROUND OF THE INVENTION

1. Field of the Invention

The present invention relates to an image processing apparatus for making a document whose originality can be certified.

2. Description of the Related Art

In order to certify the originality of a document such as a public document, soft thin paper is used or a tint block or watermark is formed on a document. It is thereby possible to clearly discriminate an original document from a copied document.

However, in the case of a document consisting of a large number of recording sheets, the use of soft thin paper is costly. Further, in the case of a document with a tint block or watermark formed thereon, repeated copying of the document, such as further copying of a copied document, makes the tint block or the watermark not recognizable, thereby preventing the copied document from being discriminated from the original document.

With such being the case, an image processing apparatus is described in Japanese Patent Laid-Open No. 2003-1905, which applies mechanical processing to a document so as to certify its originality. In this image processing apparatus, through holes arranged in a predetermined order are formed on printed recording sheets. It is possible to recognize at first sight a difference between the original document, on which the through holes are formed as thus described, and a copied document.

It is possible to certify the originality of a document with through holes formed thereon as described above. However, in a document consisting of a large number of recording sheets, if a recording sheet has been taken out and missing, or the order of pages has been changed, such defects cannot be found since each recording sheet has a through hole. Therefore, this document is incomplete as a document and incapable of certifying its originality with reliability.

SUMMARY OF THE INVENTION

In view of what was described above, an object of the present invention is to provide an image processing apparatus capable of making a document consisting of a large number of recording sheets whose originality can be certified.

The present invention comprises: an image formation section for forming an image on a recording sheet; a process section for cutting out part of the recording sheet to form a confirmation hole; and a control section for controlling the image formation section and the process section. The control section controls the image formation section so as to form a specific image on another recording sheet having a predetermined relation with the recording sheet with the confirmation hole formed thereon.

A user can see the confirmation hole and the specific image formed on recording sheet. The confirmation hole and the specific image are formed on the respective different recording sheets. Here, the confirmation hole and the specific image are respectively formed on different recording sheets having a predetermined relation, such as a higher/lower-levels relation or a successive relation so that the specific image is visible through the confirmation hole, leading to certification of the originality. However, once the predetermined relation of the recording sheets comes undone, the user becomes unable to see the specific image through the confirmation hole, thereby allowing the user to recognize that the document is not the original one.

In recording sheets outputted in constant order, a recording sheet at a lower level than the recording sheet with the confirmation hole formed thereon is regarded as another recording sheet, and the image formation section forms the specific image on this another recording sheet. Namely, another recording sheet and the recording sheet with the confirmation hole are sheets adjacent to each other, and this is the predetermined relation.

The process section forms the confirmation holes in predetermined positions of a plurality of recording sheets, and the image formation section forms the specific image, corresponding to the confirmation holes, on a predetermined position of another recording sheet. The confirmation hole and the specific image are formed in the same predetermined position of each recording sheet.

Since the confirmation hole is formed in the same predetermined position of each recording sheet, each confirmation hole forms one hole when a plurality of recording sheets are stacked. Meanwhile, since the specific image is formed in the same predetermined position as the confirmation holes, the image lies at the bottom of the holes. Hence it is possible to confirm the specific image through the confirmation holes.

The process section forms confirmation holes in a plurality of predetermined positions of one recording sheet such that the number of confirmation holes on an upper-level recording sheet is larger than the number of confirmation holes on a lower-level recording sheet, and the image formation section forms different specific images on different recording sheets according to the respective confirmation holes. Namely, the number of confirmation holes decreases with lowering of the level of the recording sheet.

A control section sets the predetermined position in the margin of the recording sheet. Thereby, the confirmation hole and the specific image are formed in the margin of the respective recording sheets. As a result, the confirmation hole and the specific image are not superimposed on images formed on the respective recording sheets, thereby preventing damage to the images.

The process section forms filing holes for filing a plurality of recording sheets, and the confirmation holes are formed in positions different from the positions of the filing holes. The specific image is not formed corresponding to the filing holes. Further, the control section inhibits formation of the confirmation hole on the highest-level recording sheet. The recording sheet of the highest level is a cover sheet. The confirmation hole is not formed on this cover sheet, and the cover sheet covers the confirmation holes formed on recording sheets at lower levels than the cover sheet. Such covering provides for better appearance of a document, and concealment of the processing applied for certifying the originality of the document.

Further, in recording sheets outputted in constant order, the process section forms the confirmation holes on successive recording sheets, and the image formation section forms the specific image on a recording paper at a lower level than the lowest-level recording sheet with the confirmation hole formed thereon. Namely, the recording sheet with the confirmation hole formed thereon and another recording sheet with the specific image formed thereon have a relation of having pages in successive order.

At this time, the image formation section forms specific images on respective another recording sheets, and the process section forms confirmation holes on a plurality of recording sheets according to the specific images. The number of recording sheets on which the confirmation holes are to be formed is determined according to each specific image, and the process section forms the confirmation holes on the corresponding recording sheets. Here, when the number of recording sheets on which the confirmation holes corresponding to the specific images are formed increases or decreases, the relation between the recording sheets on which the confirmation holes are formed and another recording sheet on which the specific image is formed changes. This makes the specific image invisible through the confirmation holes, and hence the originality of such a document cannot be certified.

The specific image is any of a letter, a symbol, a pattern, and a ground color. Further, the specific image indicates management information on an image. Addition of function as management information to the specific image leads to elimination of the need for separately forming an image indicating management information.

According to the present invention, a confirmation hole is formed on a recording sheet, and a specific image corresponding to the confirmation hole is formed on another recording sheet. With this configuration, when the specific image is visible through the confirmation hole, it is possible to certify that the document is the original one. On the other hand, when the specific image is invisible through the confirmation hole, it is found that a recording sheet is missing or the order of recording sheets has been changed, and thus the document is a document changed from the original one. This can facilitate easy discrimination as to whether or not the document is original, and can further facilitate confirmation of a defect of the document such as page missing.

BRIEF DESCRIPTION OF THE DRAWINGS

FIG. 10 shows a letter input screen in setting of the specific image.

DETAILED DESCRIPTION OF THE PREFERRED EMBODIMENTS

Figure 1:
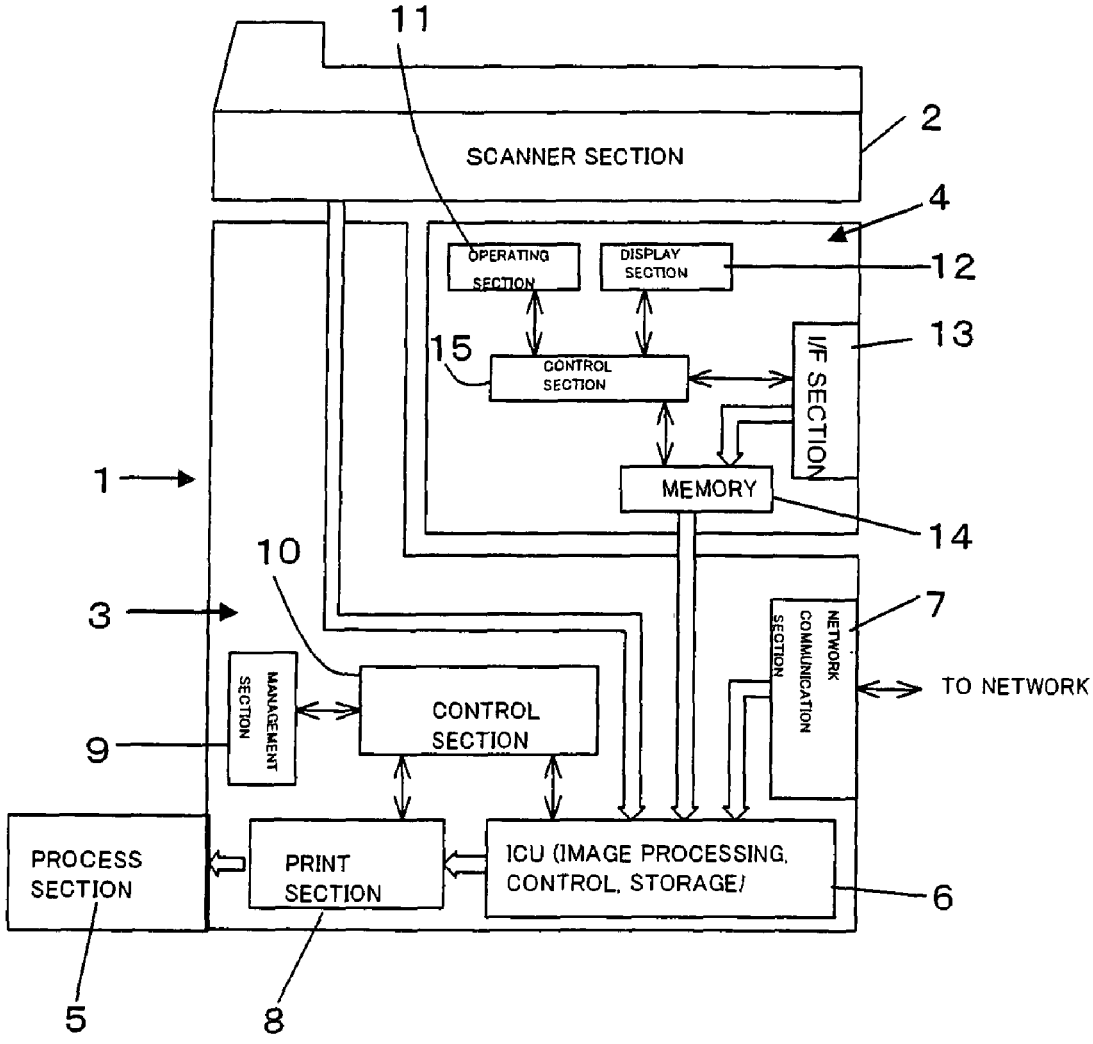
FIG. 1 is a view showing a schematic configuration of an image processing apparatus of the present invention.

FIG. 1 shows an image processing apparatus of the present embodiment. The image processing apparatus is a complex machine to execute a copy mode, a print mode, a scanner mode, and a facsimile mode. A cabinet 1 includes: a scanner section 2 for reading a document and inputting image data; an image data processing section 3 for processing image data; an information processing section 4 for processing inputted information such as authentication information; and a process section 5 for applying processing to a sheet.

The image data processing section 3 has: an image processing section 6 for performing processes of editing, storing and outputting inputted image data; a network communication section 7 for performing data communication via a network; a print section (image formation section) 8 for printing image data on a recording sheet; a management section 9 for storing control information, setting information and the like of the entire apparatus; and a device control section 10 for taking control of the entire apparatus. The image processing section 6 includes a hard disk device which stores image data, and a memory.

The information processing section 4 has: an operating section 11 for input operation; a display section 12 for displaying an operation screen; an interface section 13 for performing communication with a mobile terminal device such as a USB device and an IC card; a memory 14 for storing information such as authentication information; and a control section 15 for performing a process on inputted operational information and authentication information. The communication performed by the interface section 13 is not necessarily wired but may be wireless.

The operating section 11 and the display section 12 are provided on an operation panel. The operating section 11 includes a variety of operation keys. The display section 12 is composed of a liquid crystal display, and is a touch panel. Touch keys are formed within the operation screen displayed on the display section 12, and these keys also function as operation keys.

The process section 5 performs a post-process such as opening a hole on a recording sheet after printed. Further, the process section 5 may staple a plurality of printed recording sheets together as the post-process.

A plurality of image processing apparatuses are connected to a network such as LAN or WAN. The network is connected with a plurality of external devices. The external devices are an information processing apparatus such as a personal computer and a server. The network is connected from a router to the Internet via a communication line such as a phone line or an optical fiber. The network communication section of the image processing apparatus is made communicable to the external devices by a predetermined communication protocol through the network. Further, the image processing apparatuses are made communicable to one another. It is to be noted that the communication within the network may be wired or wireless. These image processing apparatuses and external devices form an image processing system.

Further, the image processing apparatus has a modem device, and the phone line is connected to the modem device. The image processing apparatus is capable of performing facsimile communication. Moreover, the image processing apparatus and the external device are also capable of performing data communication by Internet facsimile through the network.

The device control section 10 is composed of a microcomputer having a CPU, an ROM and an RAM. Upon input of image data, the device control section 10 executes any process of the print mode, the copy mode, the scanner mode and the facsimile mode based upon a process condition included in information inputted from the operating section 11 or header information of the image data inputted from the external device.

The image data is inputted by reading a document in the scanner section 2. The scanner section functions as an input section for inputting image data of the document. Further, the image data is transmitted from the external device to the image processing apparatus through the network. The network communication section 7 receives and then inputs the image data. In the case of receiving image data by facsimile, the modem device inputs the image data. As thus described, the network communication section 7 and the modem device function as an input section for inputting image data.

In the print mode and the copy mode, after image data is subjected to image processing in the image processing section 6, an image is printed by the print section 8 on a recording sheet. In the scanner mode, image data is stored in the hard disk device, and with a call from the external device, the image data is transmitted to the external device through the network communication section 7. In the facsimile mode, image data is transmitted to a facsimile apparatus through the modem device. As thus described, the print section 8, the network communication section 7, and the modem device function as an output section for outputting image data.

Figure 2:
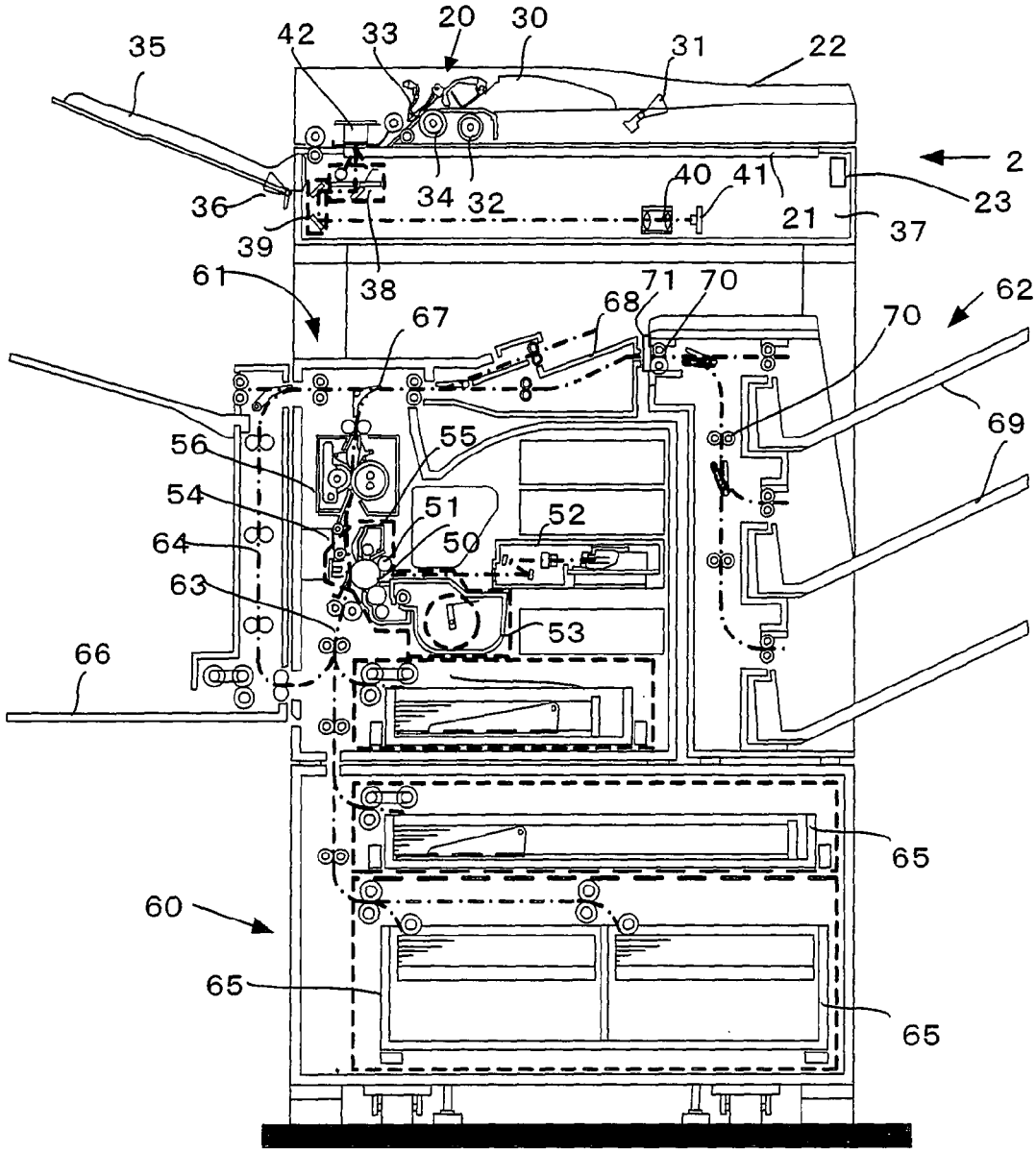
FIG. 2 is a view showing a mechanism of a scanner section and a print section of the image processing apparatus.

Here, the scanner section 2 and the print section 8 of the present image processing apparatus are described. As shown in FIG. 2, the scanner section 2 includes a document conveying device 20. The document conveying device 20 automatically conveys a document for reading image data of the document. The document conveying device 20 is located over the cabinet 1. A document table 21 made of platen glass is provided on the upper surface of the cabinet 1, and a document cover 22 for covering the document table 21 is provided. The document conveying device 20 is installed integrally with the document cover 22.

The document cover 22 is freely openable and closable. When the document cover 22 is in a closed state, a document is conveyed by the document conveying device 20. When the document cover 22 is in an open state, a document can be placed on the document table 21. A cover open/close sensor 23 for detecting opening/closing of the document cover 22 is provided to detect the open state or the closed state of the document cover 22. Further, a document size detecting sensor for detecting a size of a document placed on the document table 21 is provided.

When a document is set on a document set tray 30 of the document conveying device 20, a document detecting sensor 31 detects that the document has been set. Copy conditions such as a size of a recording sheet and scaling are then inputted on the operation panel. Subsequently, copying is started by an operation of inputting a start key.

In the document conveying device 20, documents on the document set tray 30 are pulled out one by one by a pickup roller 32. A document passes through between a separating plate 33 and a conveyance roller 34, to be sent out to the document table 21. The document is conveyed in a sub-scanning direction on the document table 21, to be ejected to a document ejection tray 35. The document ejection tray 35 is provided with a document ejection sensor 36, which detects the presence or absence of a document on the document ejection tray 35.

A reading area is formed on one side of the document table 21, and the document passes through the reading area when conveyed on the document table 21. A first scanning unit 38 of a first reading section 37 is located below the reading area, and reads the surface (lower side surface) of the document.

When the document is conveyed to the document table 21 by the document conveying device 20, the first scanning unit 38 is shifted to the reading position to be positioned, and a second scanning unit 39 is also positioned in a predetermined position. The surface of the document is irradiated from the below with an exposure lamp of the first scanning unit 38. Reflected lights from the document are led to an imaging lens 40 by the respective reflecting mirror of the first and second scanning units 38, 39. Reflected lights from the document are collected onto a CCD (charge coupled device) 41 via the imaging lens 40. An image on the surface of the document is formed on the CCD 41. Thereby, an image on the surface of the conveyed document is read.

Further, the rear surface of the document (upper side surface) is read by a second reading section 42. The second reading section 42 includes: an exposure lamp array, arranged over the document table 21 and having an LED, a fluorescent lamp or the like for applying a light onto the rear surface of the document; a Selfoc lens array for correcting reflected lights of the document by pixel; a contact image sensor (CIS), which photoelectrically converts reflected lights from the document received through the Selfoc lens array and outputs an analog image signal; and some other constituents. Thereby, an image on the rear surface of the conveyed document is read.

When a document is placed on the document table 21, an image of the surface of the document is read by the first reading section 37. The first and second scanning units 38, 39 shift in the sub-scanning direction while maintaining a predetermined rate relation therebetween. The document on the document table 21 is exposed to light by the first scanning unit 38, and reflected lights from the document are led to the imaging lens 40 by the first and second scanning units 38, 39. The image of the document is formed on the CCD 41 by the imaging lens 40.

As thus described, when one side or both sides of a document are read, image data on the one side or both sides of the document is inputted into the image data processing section 3. Here, the image processing section 6 applies a variety of image processing to the image data. This image data is outputted to the print section 8.

The image formation section 8 prints the image of the document on a recording sheet based upon the image data. The image formation section 8 includes a photoreceptor drum 50, an electrifying device 51, a laser scan unit 52, a developing device 53, a transfer device 54, a cleaning device 55, a static eliminator (not shown), a fixing device 56, and the like. In order to supply and convey a recording sheet, the image formation section 8 further includes a supply section 60, a conveying device 61, and an ejection processing device 62.

A main conveyance path 63 and a reversal conveyance path 64 are formed in the conveying device 61, and a recording sheet supplied from the supply section 60 is conveyed by a conveyance roller along the main conveyance path 63. The supply section 60 pulls out recording sheets housed in a cassette 65, or recording sheets placed on a manual tray 66, one by one and sends those sheets out to the main conveyance path 63.

The photoreceptor drum 50 and the fixing device 56 are arranged along the main conveyance path 63, and the transfer device 54 is arranged opposite to the photoreceptor drum 50 with the main conveyance path 63 provided therebetween. The recording sheet passes through between the photoreceptor drum 50 and the transfer device 54, and then passes through the fixing device 56. During such passage, the recording sheet is printed.

The photoreceptor drum 50 rotates in one direction, and the cleaning device 55 and the static eliminator remove static on the surface of the photoreceptor drum 50 and clean the surface. The electrifying device 51 electrifies the surface of the photoreceptor drum 50 uniformly. The laser scan unit 52 modulates a laser light based upon the image data from the scanner section 2, and repeatedly scans the surface of the photoreceptor drum 50 in a main scanning direction using this laser light, to form a static latent image on the photoreceptor drum 50. The developing device 53 supplies toner to the front surface of the photoreceptor drum 50 and develops the static latent image to form a tenor image on the surface of the photoreceptor drum 50. The transfer device 54 transfers the toner image on the surface of the photoreceptor drum 50 to the recording sheet. The fixing device 56 heats and pressurizes the recording sheet to fix the toner image onto the recording sheet.

A branch pawl 67 is arranged at the connecting position of the main conveyance path 63 and the reversal conveyance path 64. The branch pawl 67 is freely rotatable, and its orientation is switched. When printing is made only on one side of the recording sheet, the branch pawl 67 is switched to be oriented for conveyance, and by this branch pawl 67, the recording sheet from the fixing device 56 is led to the ejection tray 68 or the ejection processing device 62. When printing is made on both sides of the recording sheet, the branch pawl 67 is switched to be reverse oriented, and the recording sheet is led to the reversal conveyance path 64. The recording sheet then passes through the reversal conveyance path 64 to be turned upside down, and conveyed back to the main conveyance path 63. During this conveyance, printing is made on the rear surface of the recording sheet.

The recording sheet with an image printed thereon is ejected from the main conveyance path 63 to either the ejection tray 68 or any of the ejection trays 69 of the ejection processing device 62.

The ejection processing device 62 has a plurality of conveyance roller 70, and sorts and ejects recording sheets to the ejection trays 69. Namely, when a plurality of documents are made, the ejection processing device 62 sorts the plurality of recording sheets and ejects them to the ejection trays 69 such that one document is allocated to each of the ejection trays 69.

The process section 5 is provided with a punch unit 71 for making a hole by punching a recording sheet. The punch unit 71 is provided in the vicinity of an inlet of the ejection processing device 62 which gets through the main conveyance path 63. The device control section 10 controls the punch unit 71 and the ejection processing device 62 so that a hole is punched in a recording sheet in passage of the recording sheet through the punch unit 71.

Figure 3:
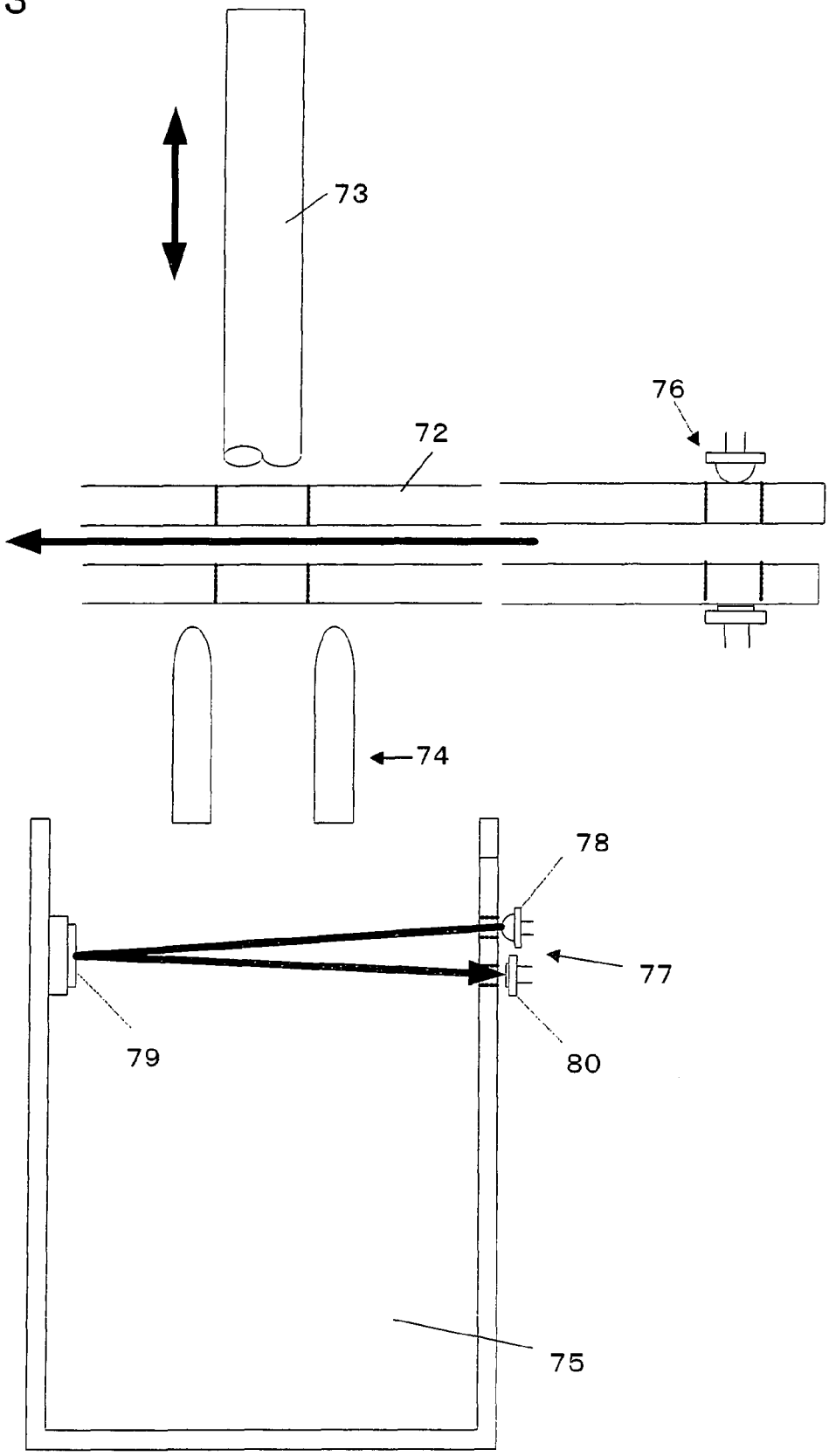
FIG. 3 is a view showing a schematic configuration of a punch unit.

As shown in FIG. 3, the punch unit 71 is provided with a die 73 and a guide plate 74 with a conveying path 72 arranged therebetween. The die 73 is connected to a cam rotationally driven by a motor. As the cam rotates, the die 73 reciprocates, entering into between a pair of guide plates 74 and then moving back. At this time, the die 73 punches a recording sheet passing through the conveying path 72, to punch a hole in the recording sheet. A punch chip container 75 is provided under the guide plate 74, which collects a punch chip generated by punching.

Figure 4A:
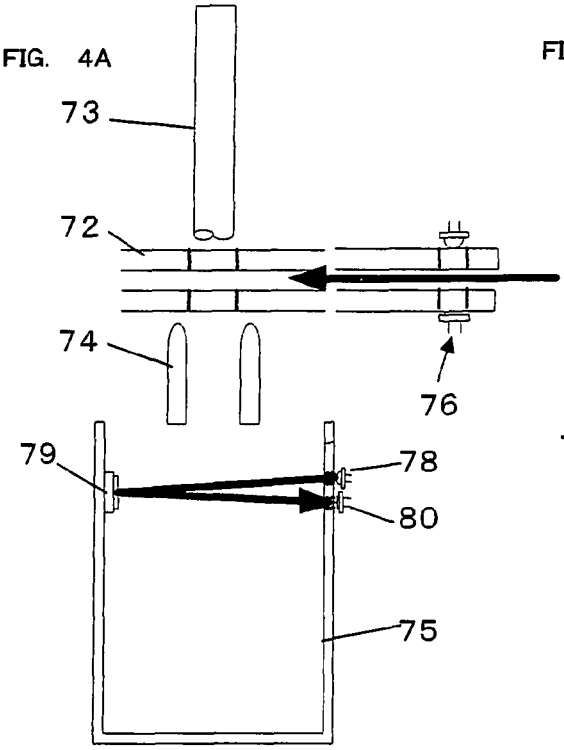
FIG. 4 is a view showing a punching operation of a punch unit.
Figure 4B:
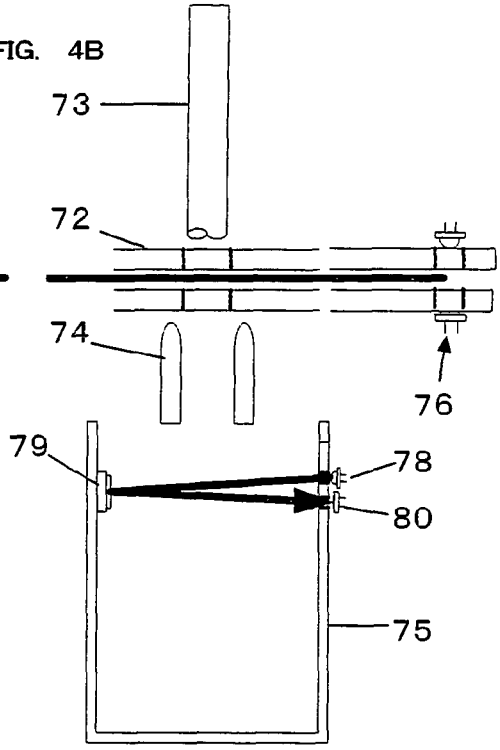

The punching operation of the punch unit 71 is described. As shown in FIG. 4A, a printed recording sheet enters into the conveying path 72 from the main conveyance path 63, and is conveyed by the conveyance roller 70 within the ejection processing device 62. As shown in FIG. 4B, when the rear end of the recording sheet is detected by the sheet detection sensor 76, the device control section 10 stops conveyance of the recording sheet and drives the punch unit 71.

Figure 4C:
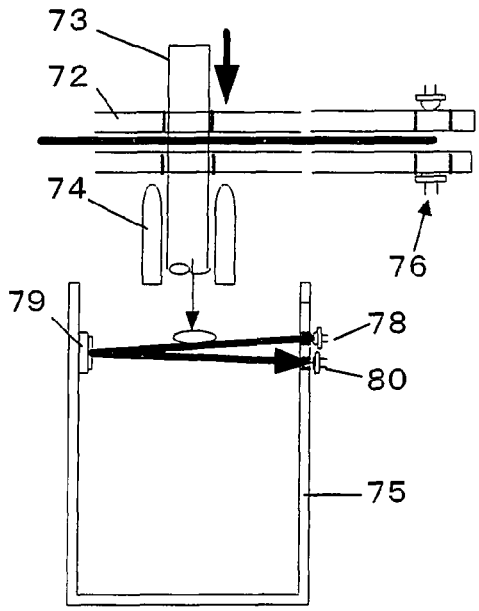

As shown in FIG. 4C, the die 73 reciprocates and punches the recording sheet out to form a hole therein. A punch chip generated at this time drops into the punch chip container 75. The punch chip container 75 is provided with a photosensor 77 for detecting drop of a punch chip. A light emitted from a light emitting element 78 of the photosensor 77 is reflected by a reflection plate 79 and received by a light receiving element 80. When a punch chip drops, this light is blocked, and thus not received by a light receiving element 80.

Figure 4D:
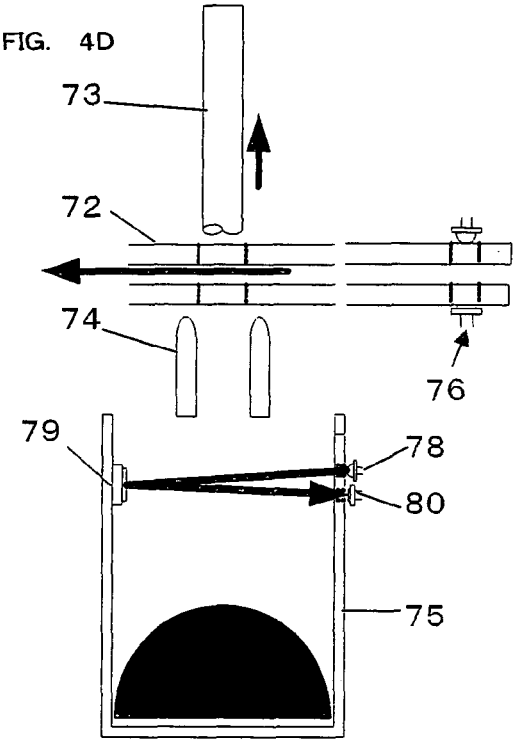

The device control section 10 detects completion of punching by a change from an on-output to an off-output of the light receiving element 80. Subsequently, as shown in FIG. 4D, the device control section 10 starts conveying a recording sheet to eject it to the ejection trays 69.

When a plurality of holes are punched in a recording sheet, the device control section 10 controls a punch unit 71 so as to repeat punching by conveying the recording sheet by a predetermined amount every time one punching is completed. This allows formation of a plurality of holes at predetermined intervals on the recording sheet.

It is to be noted that a plurality of sets of the die 73 and the guide plate 74 may be provided so that a plurality of holes can be simultaneously punched in a recording sheet. Further, the die 73 and the guide plate 74 may be made shiftable so that holes are made in arbitrary positions of a recording sheet.

Figure 5:
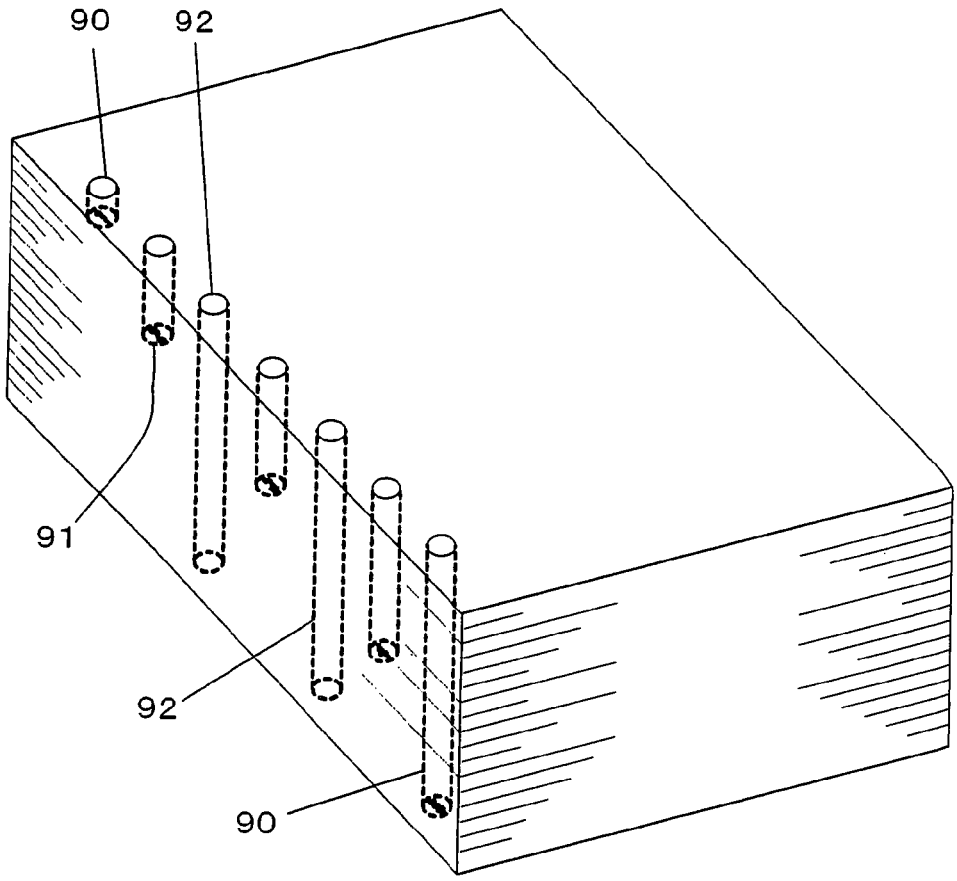
FIG. 5 is a perspective view of a document whose originality can be certified.

For the purpose of certifying the originality of a document consisting of a plurality of recording sheets which was made by printing images, as shown in FIG. 5, the present image processing apparatus forms confirmation holes 90 on the recording sheets and also forms a specific image 91, which corresponds to the confirmation holes 90, on another recording sheet.

This document is configured by a plurality of recording sheets outputted in constant order. For example, recording sheets are stacked in order of pages to make one document. The confirmation holes 90 are formed on a plurality of recording sheets successively arranged from the higher level to the lower level. The specific image 91 is formed on a recording sheet at a lower level than the lowest-level recording sheet with the confirmation hole 90 formed thereon. Namely, another recording sheet on which the confirmation hole 90 is formed has an adjacent relation with the lowest-level recording sheet with the confirmation hole 90 formed thereon. It should be noted that the upper level and the lower level here are irrelevant to the order of pages, but refer to levels in a higher/lower-levels relation among stacked recording sheets.

Further, a plurality of confirmation holes 90 are formed. The confirmation holes 90 are formed respectively in different predetermined positions. The higher the level of a recording sheet, the larger the number of confirmation holes 90 formed on the recording sheet. A plurality of specific images are formed corresponding to the confirmation holes 90. The specific images are formed in the same predetermined positions on the respective recording sheets as the predetermined positions of the confirmation holes 90.

The specific image 91 is any of, for example, a letter, a symbol, a pattern, a ground color, or a combined image thereof. The specific images 91 corresponding to the respective confirmation holes 90 are different images. However, there is no harm in making the plurality of specific images 91 identical with one another.

When the specific image 91 is a pattern or a symbol, the image may be an image indicating management information. The management information is information concerning image formation, information concerning image data, and the like, which can be used as track information. Further, the management information may be information concerning encrypted keys. It is possible to make an encrypted key from the specific image 91 formed on a recording sheet so as to encrypt, with the encrypted key, image data formed by reading the image printed on this recording sheet.

Figure 6:
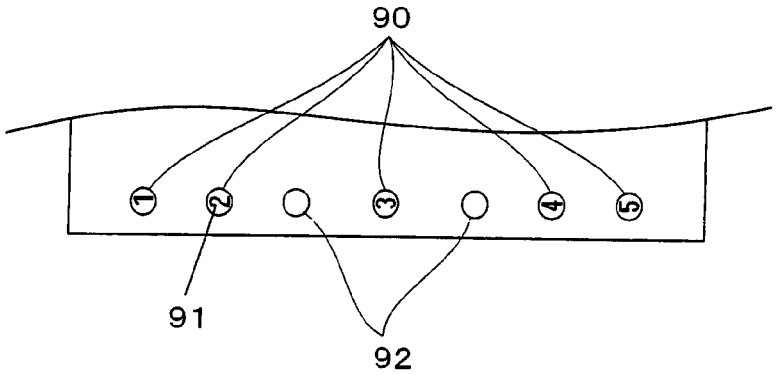
FIG. 6 is a plan view of part of a document as seen from the top.
Figure 7:
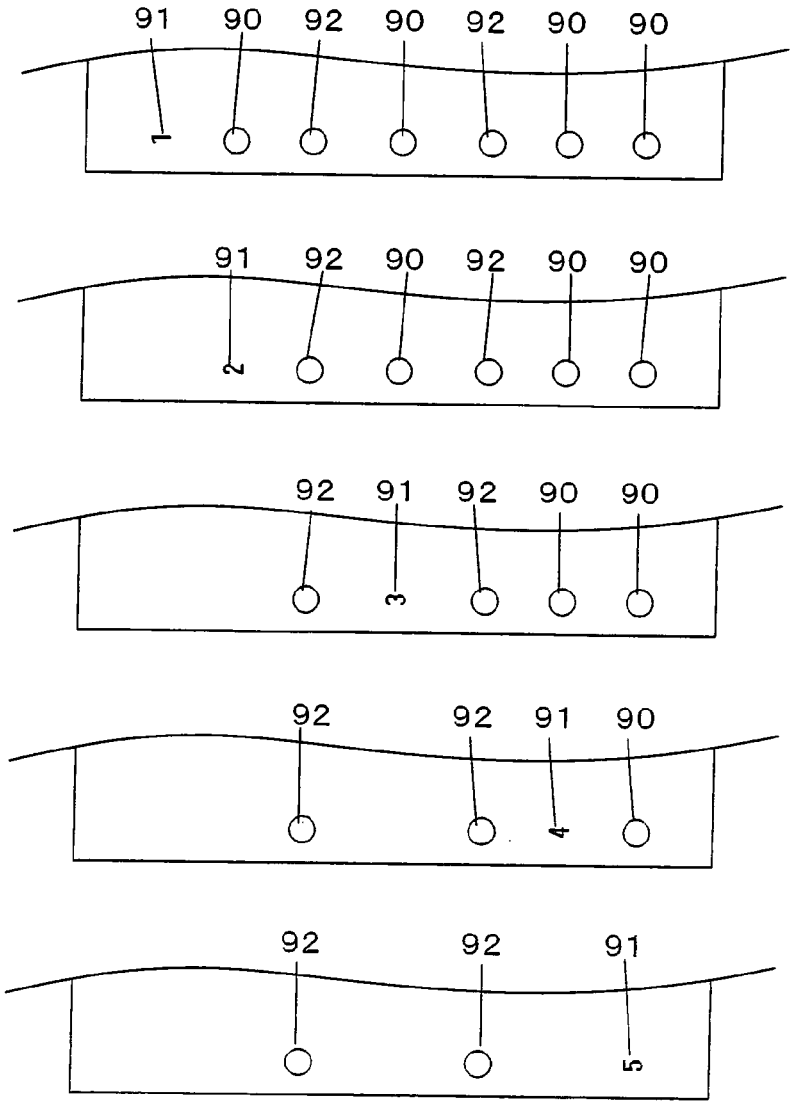
FIG. 7 is a plan view showing part of recording sheets arranged in order from the higher level to the lower level.

As shown in FIG. 6, in a document with a plurality of recording sheets stacked in constant order, the user can see the specific images 91 through the confirmation holes 90 when seeing the document from the above. As shown in FIG. 7, five confirmation holes 90 and two filing holes 92 are formed on the highest-level recording sheet. It is to be noted that the filing hole 92 is formed on every recording sheet. The confirmation hole 90, the filing hole 92 and the specific image are formed in the margin of a recording sheet.

In recording sheets at lower levels, five specific images 91 are formed on different recording sheets corresponding to the respective confirmation holes 90. Namely, one specific image 91 and four confirmation holes 90 are formed on the recording sheet at a lower level than the highest level. Further, one specific image 91 and three confirmation holes 90 are formed on a recording sheet at a further lower level. The lower the level of the recording sheet, the fewer the number of the confirmation holes formed on the recording sheet.

Here, when the specific image 91 is invisible through the confirmation hole 90, it is considered that part of recording sheets is missing or the order of pages of recording sheets has been changed. This means that some arrangement has been made on the document. Accordingly, visibility of the specific image 91 through the confirmation holes 90 enables certification of the originality of the document.

In order to make a document having the confirmation holes 90 and the specific image 91 combined in the manner as thus described, the device control section 10 controls the image formation section 8 and the punch unit 71 so as to form the confirmation holes 90 and the special images 91 on predetermined recording sheets.

Figure 8:
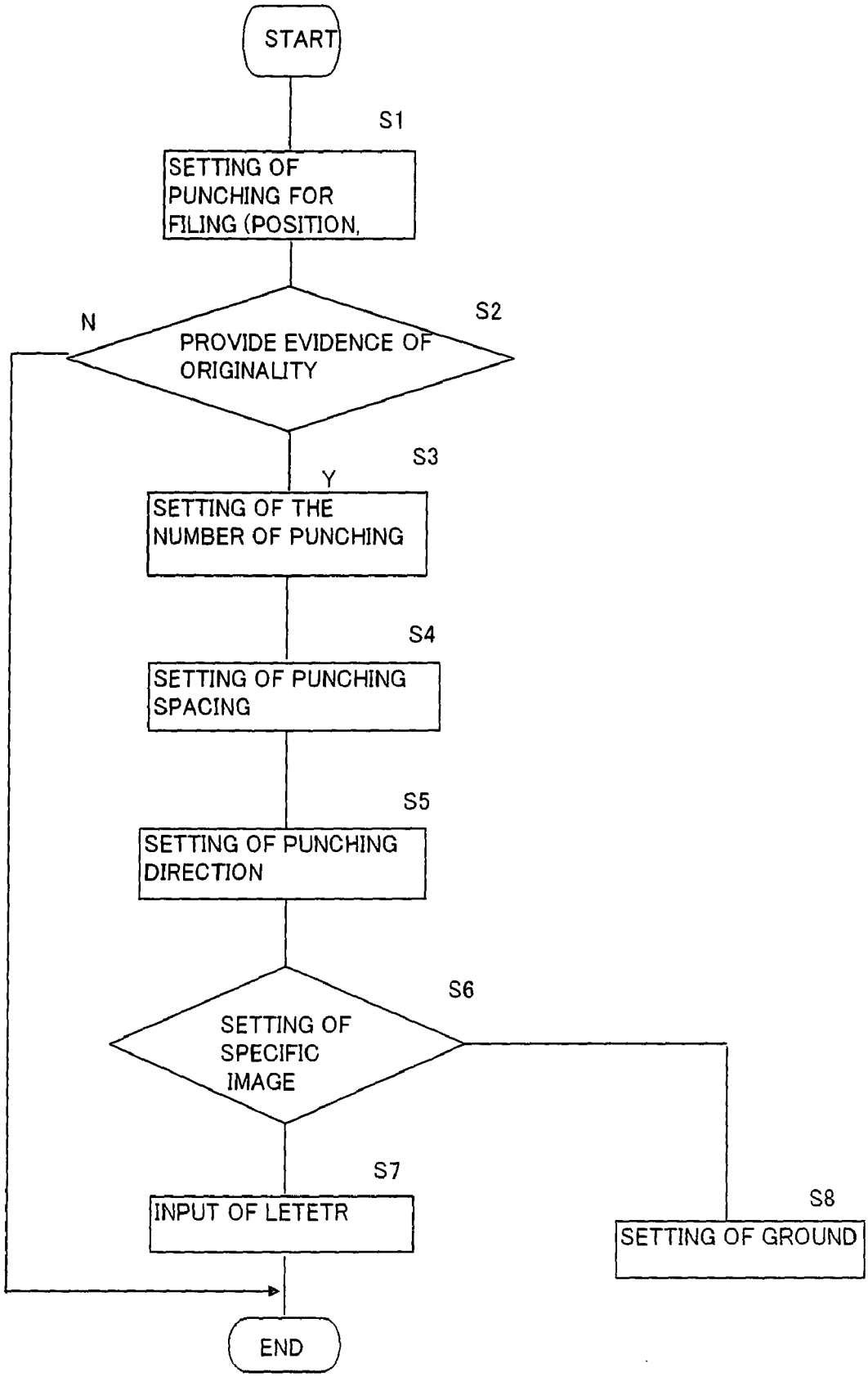
FIG. 8 is a flowchart in setting of the confirmation hole and the specific image.

In making a document as the original one, the device control section 10 executes above-mentioned punching and formation of specific images based upon an instruction to provide an evidence of the originality. Here, patterns of the confirmation holes 90 and the specific images 91 can be arbitrarily set by the user. Such a setting operation is described according to FIG. 8.

Figure 9:
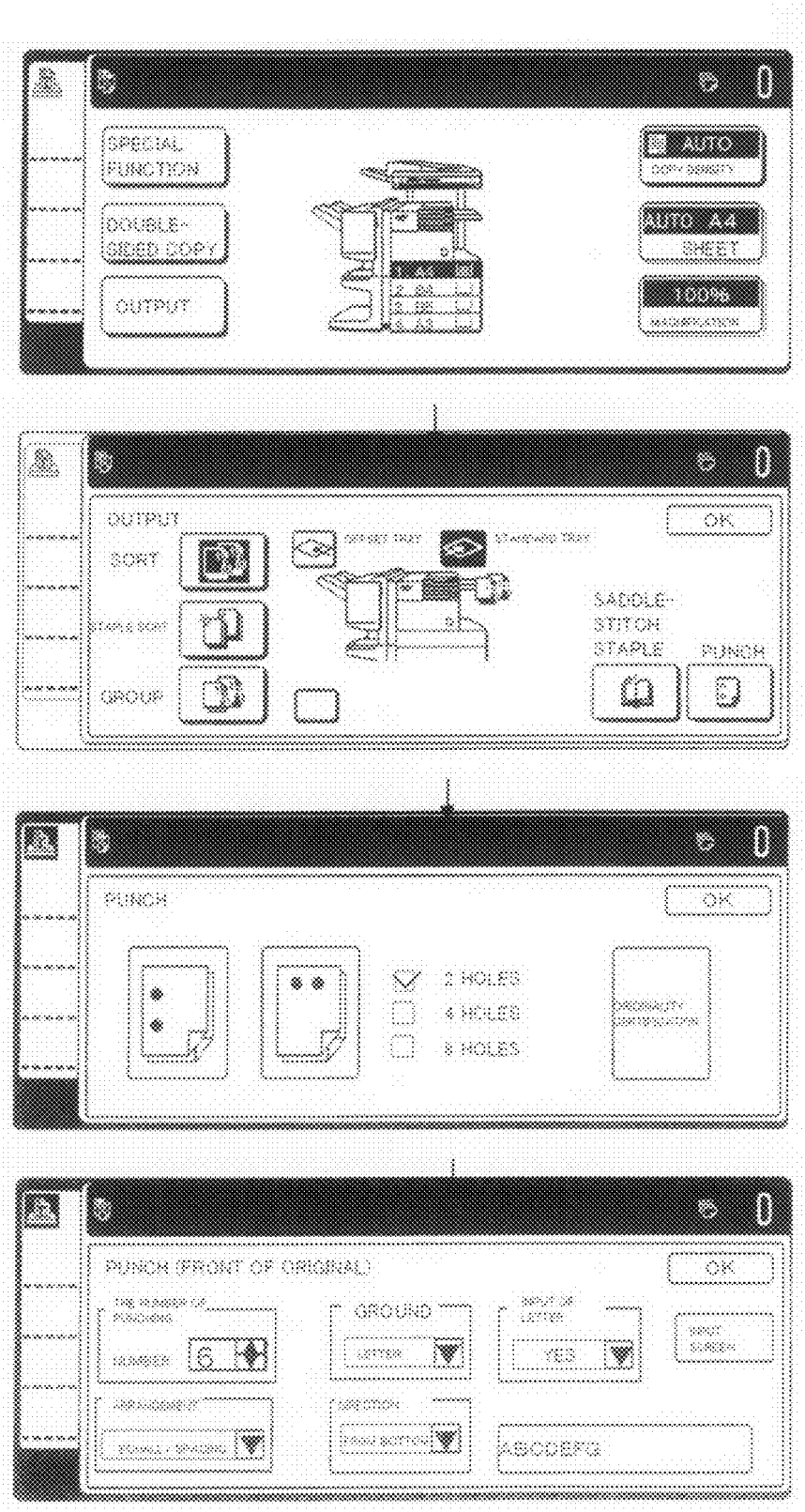
FIG. 9 is a view showing an operation image in setting of the confirmation hole and the specific image.

In the copy mode, a source document is copied to make a document as the original one. First, as shown in FIG. 9, when the user operates an operation key for "output" on the operation screen of the copy mode displayed on the operation panel, a punch chip setting screen is displayed. In this screen, positions of filing holes as well as the number of punching can be set (S1). When an operation key for "originality certification" is operated (S2), a punch setting screen for originality certification is displayed.

The user sets the number of punching of the confirmation holes 90 (S3), sets arrangement of the confirmation holes 90 (S4), and sets the punching direction of the confirmation holes 90 (S5). As the arrangement of the confirmation holes 90, either equally spacing or random arrangement can be selected. The predetermined position where the confirmation hole 90 is formed can be set in the margin of a recording sheet and cannot be set in an area where an image is printed, as in the case of the filing holes 92.

As the punching direction of the confirmation holes 90, either an upward or downward direction can be selected. For example, when a document is placed in ascending order of pages, the confirmation holes 90 can be formed in ascending order of pages when the punching direction is set to the upward direction. The confirmation holes 90 are formed in descending order of pages when the punching direction is set to the downward direction.

Figure 10A:
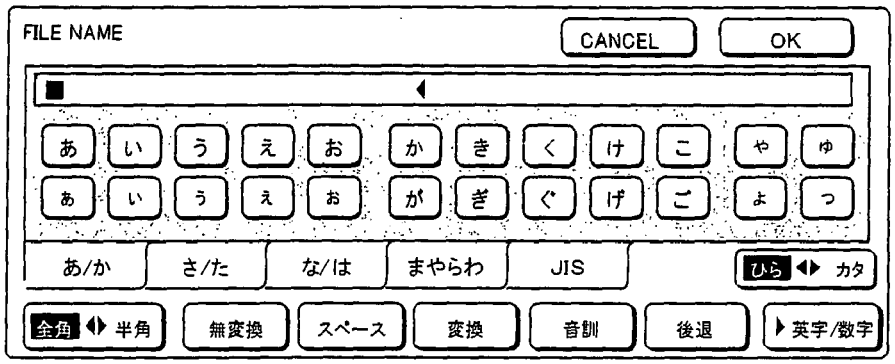
FIG. 10A is a view showing a hiragana input screen.
Figure 10B:
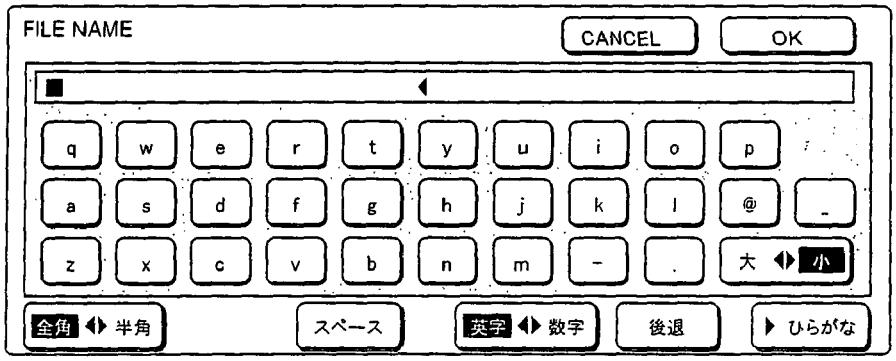
FIG. 10B is a view showing an alphanumeric input screen.

Further, the user sets the figuration of the specific image 91 (S6). For example, any of a letter, a symbol, a pattern, and a ground color can be selected. When the letter is selected, as shown in FIG. 10, a letter input screen is displayed, and an arbitrary letter can be set from either hiragana or alphanumeric (S7). When the symbol or the pattern is selected, in the same manner as above, a symbol selection screen or a pattern selection screen is displayed so that an arbitrary symbol or pattern can be set. When the ground color is selected, a basic color can be set (S8).

It should be noted that recording sheets with the specific image 91 formed thereon are recording sheets corresponding to pages designated by the user. Or, the device control section 10 may designate pages at random. Further, the special images 91 may be formed on all remaining pages except for the highest-level page. In this case, when the highest-level page is a cover page, the specific images 91 are set to be page numbers. This leads to elimination of the need for printing page numbers.

Moreover, the confirmation hole 90 may not be formed on the highest-level page. Namely, the device control section 10 inhibits formation of the confirmation hole 90 on a recording sheet at the highest level. In this case, the specific image 91 is not formed on a next page. The highest-level page is often a cover page. Therefore, forming no confirmation hole 90 on the cover sheet makes the confirmation holes 90 at lower levels invisible and thus the appearance of the document becomes better.

Figure 11:
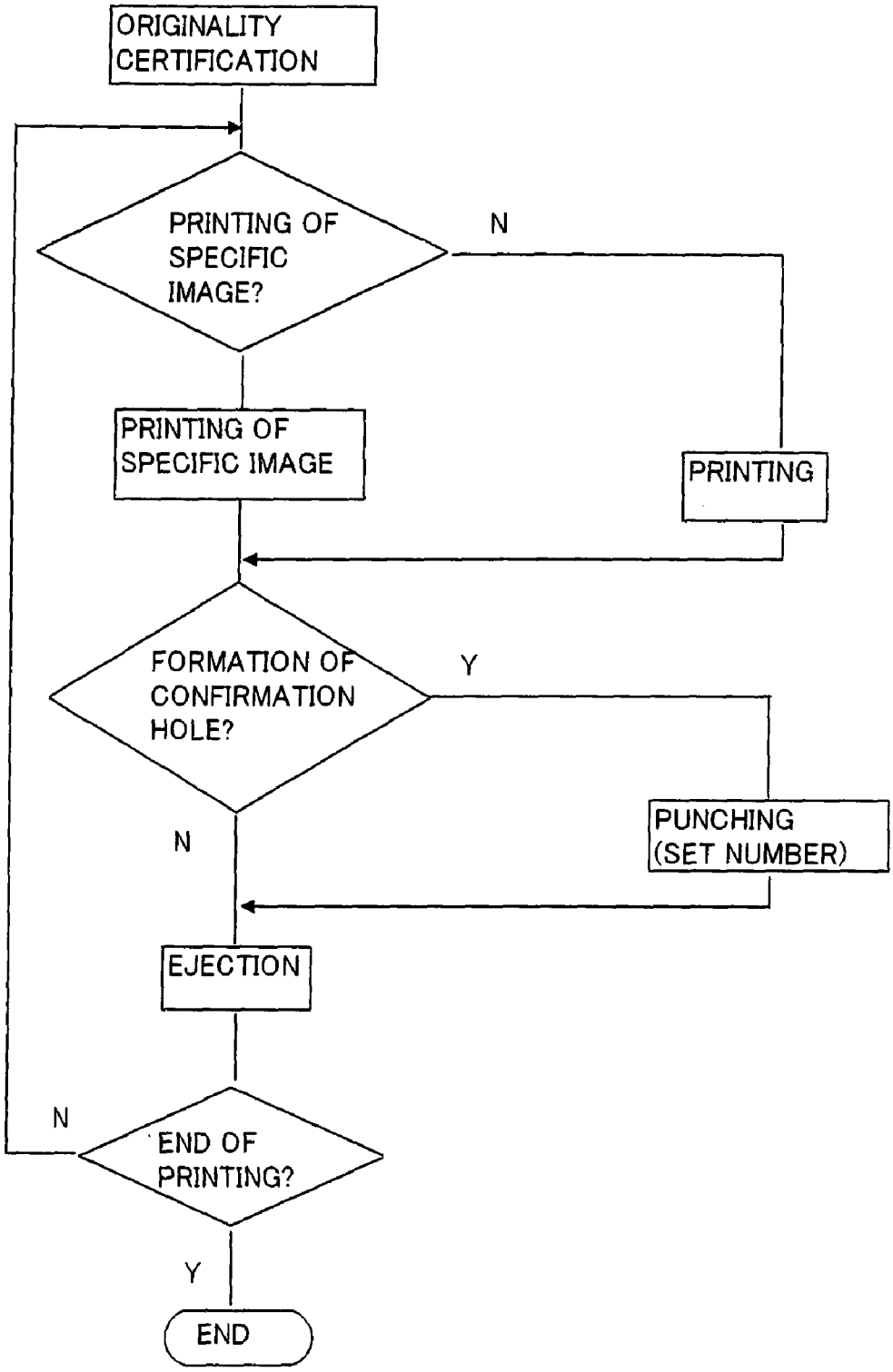
FIG. 11 is a flowchart in formation of the confirmation hole and the specific image on the recording sheets.

When the user completes setting and operates an operation key for "OK", the device control section 10 accepts the instruction to provide an evidence of the originality. When the start key is operated, as shown in FIG. 11, the device control section 10 executes the copy mode for making a document where its originality is certified. The image formation section 8 prints an image on a recording sheet based upon inputted image data. The device control section 10 previously determines pages on which the special images 91 are to be formed and pages on which the confirmation holes 90 are to be formed. When an image is printed, the device control section 10 confirms whether or not the current page is a page on which the specific image 91 is to be formed. When the current page corresponds to the page on which the specific image 91 is to be formed, the device control section 10 outputs image data of the specific image 91 to the image formation section 8. The image formation section 8 synthesizes the specific image 91 into the inputted image, and prints the synthesized image on the recording sheet. When the current page does not correspond, the inputted image is printed.

When the printed recording sheet is ejected, the device control section 10 confirms whether or not the current page is a page on which the confirmation hole 90 is to be formed. When the current page corresponds to the page on which the confirmation hole 90 is to be formed, the punch unit 71 performs punching according to the determined number of confirmation holes 90. When the confirmation holes 90 are formed in the determined number, the recording sheet is ejected to the ejection trays 69. When the current page does not correspond, the recording sheet is ejected to the ejection trays 69 as it is. It should be noted that, when the filing holes 92 have been set, the punch unit 71 forms the filing holes 92 by punching regardless of the presence or absence of the confirmation hole 90.

Figure 12A:
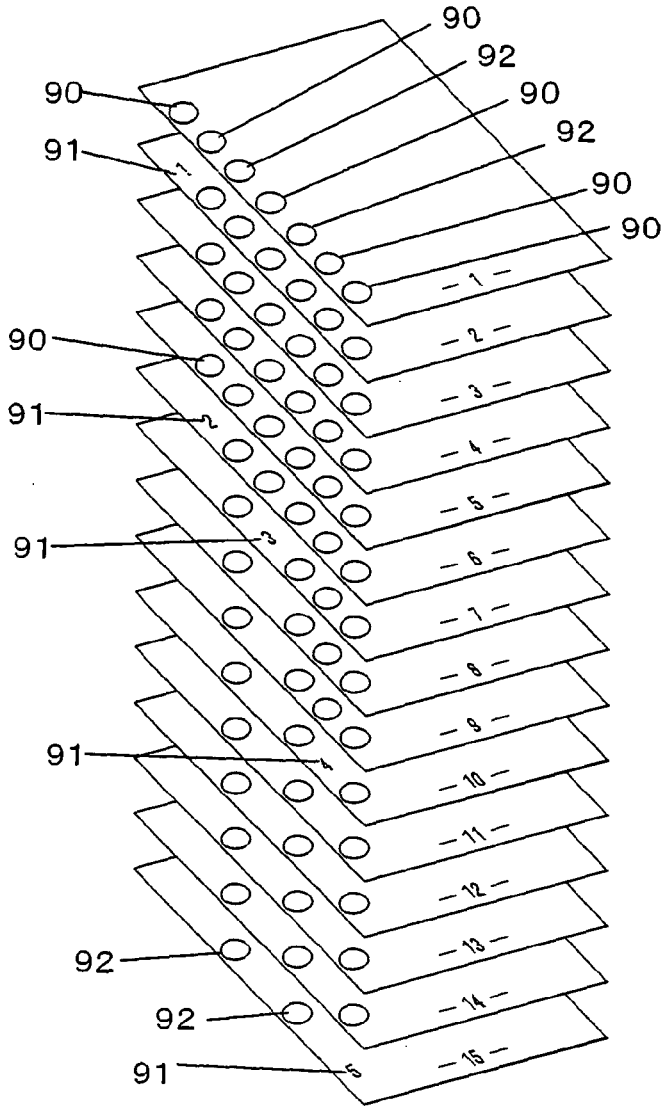
FIG. 12A is a perspective view of a document with the confirmation holes and the specific images formed thereon.
Figure 12B:
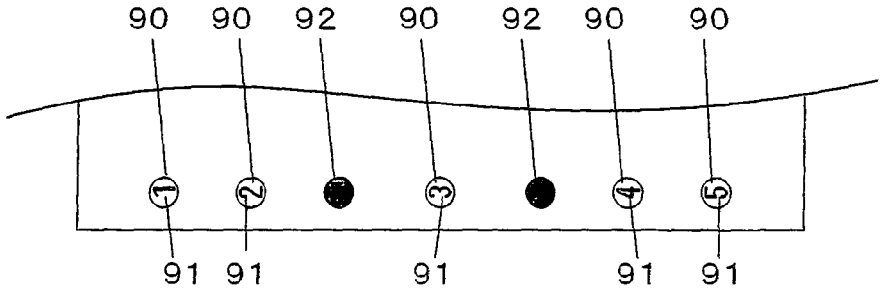
FIG. 12B is a plan view of part of the document as seen from the top.

The above-mentioned formation of the specific image 91 and formation of the confirmation hole 90 are repeated until printing of all recording sheets is completed. When the printing is completed, as shown in FIG. 12, a plurality of recording sheets are stacked in constant order, e.g. in ascending order of pages, on the ejection trays 69. When this document is seen from the top, the different specific images 91 can be confirmed from the respective confirmation holes 90. Thereby, the originality of this document can be certified.

Figure 13A:
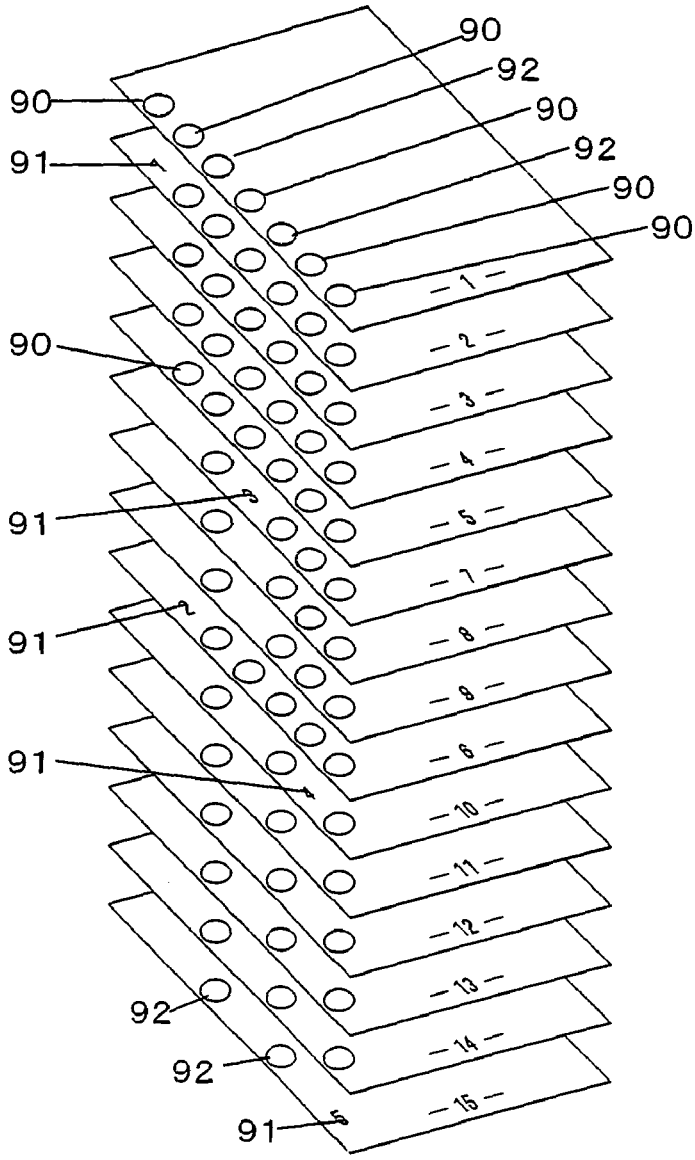
FIG. 13A is a perspective view of a document with one recording sheet shifted.
Figure 13B:
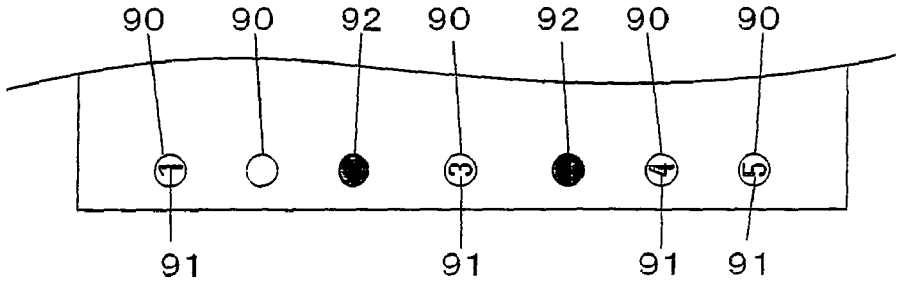
FIG. 13B is a plan view showing part of the document as seen from the top.

As shown in FIG. 13, when the order of recording sheet has been changed, for example when a recording sheet of page 6 has been shifted to between recording sheets of pages 9 and 10, the specific image 91 formed on page 6 is invisible from the above. This also applies to the case where the recording sheet of page 6 is missing. In those cases, the document has a defect and its originality cannot be certified.

Figure 14A:
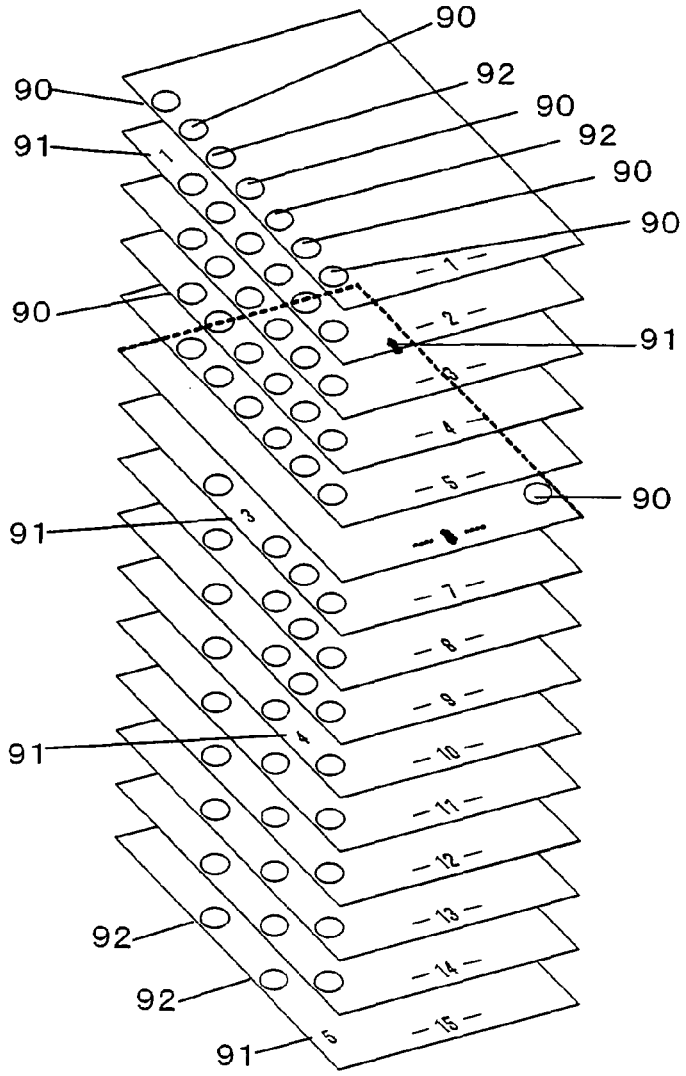
FIG. 14A is a perspective view of a document with one recording sheet turned upside down.
Figure 14B:
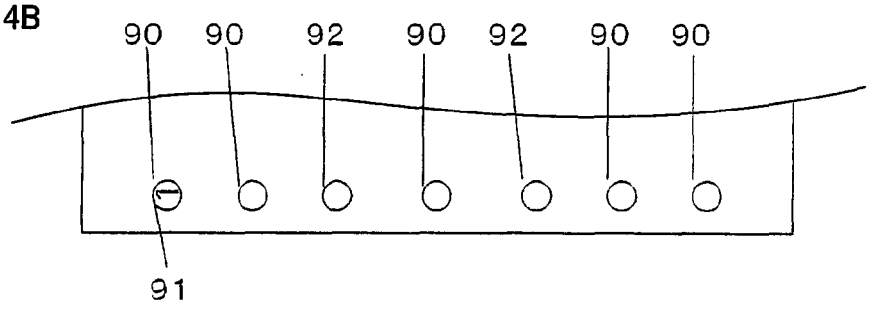
FIG. 14B is a plan view showing part of the document as seen from the top.

As shown in FIG. 14, when the recording sheet has been turned upside down, for example, when the recording sheet of page 6 has been turned upside down, the positions of the confirmation holes 90 change. When seen from the top, the confirmation holes 90 on pages at lower levels than page 6 are covered by the recording sheet of page 6, and the specific images 91 are invisible. This also applies to a case where a recording sheet of an arbitrary page is replaced with a recording sheet with no confirmation hole 90 formed thereon, or a case where a recording sheet with no confirmation hole 90 is inserted. In those cases, the document has a defect and its originality cannot be certified.

As thus described, arrangement made by a third person causes inconsistency of recording sheets arranged in constant order. As a result, it is possible to easily recognize that a relation between the specific image 91 and the confirmation hole 90 comes undone, and the document has changed to a state different from that of the original document. It is thus possible to certify that the document is not the original one. Further, when the document is copied, no confirmation hole 90 is formed on the copied recording sheets, to facilitate recognition that the document is not the original one.

It is to be noted that the present invention is not limited to the above embodiments. A large number of corrections as well as changes can naturally be added to the above embodiments within the range of the present invention. Even in the case of making printing in the printing mode or making printing of image data received in the facsimile mode, the printing may be set to provide an evidence of the originality, so as to make a document capable of certifying its originality.

Figure 15:
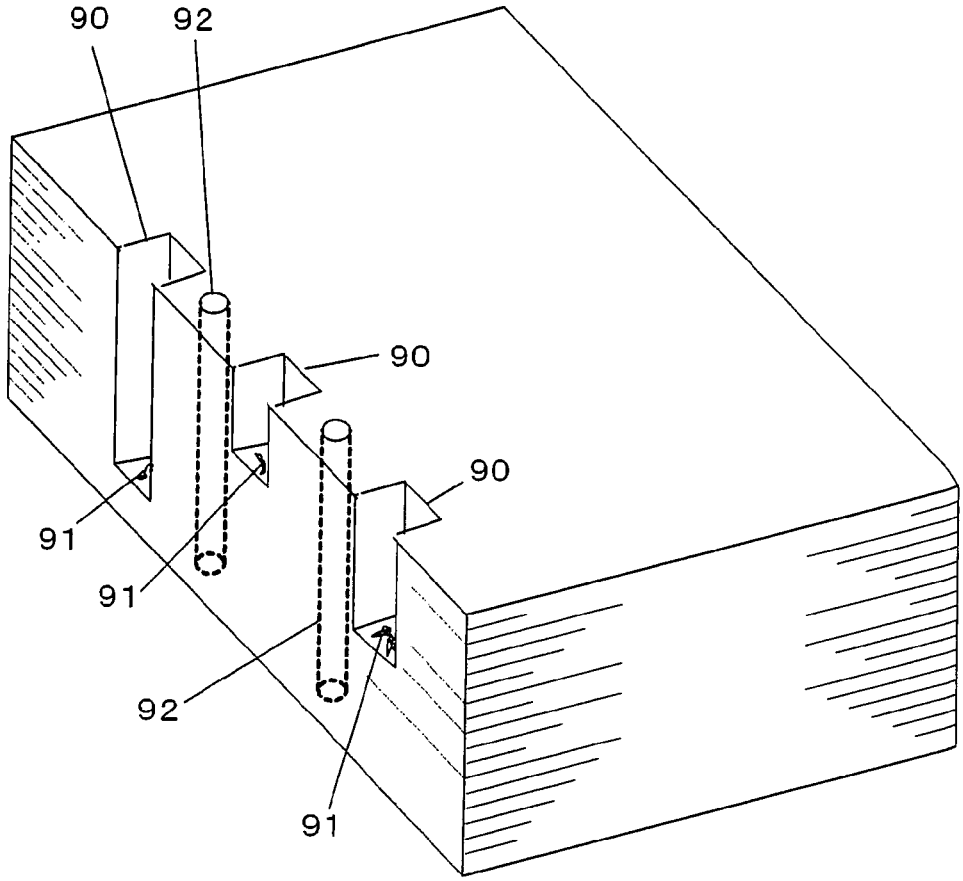
FIG. 15 is a perspective view of a document with confirmation holes in another form formed thereon.

The confirmation hole is not limited to a hole formed by punching out a recording sheet, but as shown in FIG. 15, the confirmation hole may be a notched hole formed by notching the edge of a recording sheet. The punch unit is capable of forming not only a round hole but also a square hole. Further a predetermined position for forming a confirmation hole is not limited to the margin of a recording sheet, but may be within an area where an image is formed.

What is claimed is:

1. An image processing apparatus, comprising:

an image formation section for forming an image in a predetermined position on a recording sheet;

a process section for cutting out part of the recording sheet to form a confirmation hole; and a control section for controlling the image formation section and the process section, wherein the control section controls the image formation section so as to form a specific image in a predetermined position, visible through a confirmation hole, on another recording sheet when a plurality of recording sheets with confirmation holes are stacked, and further controls the processing section so as not to form a confirmation hole on a recording sheet at a lower level than the recording sheet with the specific image.

2. The image processing apparatus according to claim 1, wherein, in recording sheets outputted in constant order, a recording sheet at a lower level than the recording sheets with the confirmation holes formed thereon is regarded as another recording sheet, and the image formation section forms the specific image on this another recording sheet.

3. The image processing apparatus according to claim 2, wherein:

the process section forms the confirmation holes in predetermined positions of a plurality of recording sheets so as to form one hole when a plurality of recording sheets are stacked; and the image formation section forms the specific image corresponding to the confirmation holes on a predetermined position of another recording sheet.

4. The image processing apparatus according to claim 3, wherein:

the process section forms confirmation holes in a plurality of predetermined positions of one recording sheet such that the number of confirmation holes on an upper-level recording sheet is larger than the number of confirmation holes on a lower-level recording sheet; and the image formation section forms different specific images on different recording sheets according to the respective confirmation holes.

5. The image processing apparatus according to claim 3, wherein the control section sets the predetermined position in the margin of the recording sheet.

6. The image processing apparatus according to claim 2, wherein the process section forms filing holes for filing a plurality of recording sheets, and the confirmation holes are formed in positions different from the positions of the filing holes.

7. The image processing apparatus according to claim 2, wherein the control section inhibits formation of the confirmation hole on the highest-level recording sheet.

8. The image processing apparatus according to claim 1, wherein:

the process section forms the confirmation holes on successive recording sheets of recording sheets outputted in constant order; and the image formation section forms the specific image on a recording paper at a lower level than the lowest-level recording sheet with the confirmation hole formed thereon.

9. The image processing apparatus according to claim 8, wherein:

the image formation section forms specific images on respectively different another recording sheets; and the process section forms confirmation holes on a plurality of recording sheets according to the recording sheets with the specific images formed thereon so that the number of confirmation holes decreases with lowering of the level of the recording sheet.

10. The image processing apparatus according to claim 1, wherein the specific image is any of a letter, a symbol, a pattern, and a ground color.

11. The image processing apparatus according to claim 10, wherein the specific image indicates management information on an image.

* * * * *